United States Patent [19]

Browning

[11] 4,149,282

[45] Apr. 17, 1979

[54] BATHTUB SUPPORT GRIP

[76] Inventor: Ernest C. Browning, 2383 Zallinger Rd., Columbus, Ohio 43221

[21] Appl. No.: 844,351

[22] Filed: Oct. 21, 1977

Related U.S. Application Data

[63] Continuation of Ser. No. 716,291, Aug. 20, 1976, abandoned.

[51] Int. Cl.[2] ..... A47K 3/12

[52] U.S. Cl. ..... 4/185 H

[58] Field of Search ..... 4/185 H, 185 R

[56] References Cited

U.S. PATENT DOCUMENTS

| | | | |
|---|---|---|---|
| 1,827,575 | 10/1931 | Germershausen | 4/185 H |
| 2,059,171 | 10/1936 | Harris | 4/185 H |
| 2,694,813 | 11/1954 | Cartwright et al. | 4/185 H |
| 3,028,604 | 4/1962 | Warner | 4/185 H |
| 3,551,921 | 1/1971 | Fox et al. | 4/199 |

*Primary Examiner*—Henry K. Artis

*Attorney, Agent, or Firm*—Melville, Strasser, Foster & Hoffman

[57] ABSTRACT

A bathtub support grip for use in combination with a bath drain assembly of the type having a face plate secured adjacent a wall of the tub by means cooperatively associated with the drain overflow head. The support grip comprises a structure directly associated with the face plate and is configured for grasping by a bather's hand to at least partially support and facilitate the bather in raising and lowering himself in the tub.

6 Claims, 4 Drawing Figures

BATHTUB SUPPORT GRIP

REFERENCE TO RELATED APPLICATION

This application is a continuation of application Ser. No. 716,291, filed Aug. 20, 1976, in the name of the same inventor, entitled BATHTUB SUPPORT GRIP and now abandoned.

BACKGROUND OF THE INVENTION

The present invention relates generally to body support apparatus and more particularly to a support grip of the type adapted to assist a bather in raising and lowering himself in a bathtub.

It is known in the prior art to provide handle grips or the like which a bather may grasp to at least partially support his weight to facilitate raising and lowering himself in a bathtub. Support grips of this type are typically mounted in a wall adjacent the bathtub and frequently comprise loop-like structures which may be conveniently grasped by a bather. It is not uncommon to find grips of this general type in association with soap retaining trays.

One serious deficiency associated with prior art bathtub support grips relates to their durability over extended periods of time. As previously mentioned, tub support grips are typically mounted on a wall adjacent the bathtub and secured thereto by various means such as lead plugs, retaining screws and the like. However, regardless of the manner in which the grip is secured to the wall, after a period of use its attachment will tend to weaken and may eventually become completely disengaged from its mounting on the wall.

SUMMARY OF THE INVENTION

Accordingly, it is an object of the present invention to provide a bathtub support grip which is mountable for use by a bather over extended periods of time without tending to loosen or otherwise become disengaged from its mounted position. In accordance with the foregoing and other useful objects, the apparatus of the present invention comprises a loop-like support grip mounted in association with the face plate of a bathtub drain assembly. The support grip is thereby anchored to the internal plumbing associated with the bathtub drain assembly such that the grip may be used indefinitely without tending to loosen or disengage from its mounting.

In one embodiment of the present invention, the support grip and drain assembly face plate comprise a unitary structure securely fastened to the internal plumbing associated with the drain assembly. In further embodiments of the invention the support grip includes means for receiving the drain assembly face plate mounting screws for securing the grip to the face plate. In the latter mentioned embodiment, the support grip may be mounted completely overlying the face plate, or, alternatively, partially underlying and extending from the face plate.

DESCRIPTION OF THE PREFERRED EMBODIMENTS

Figure 1:
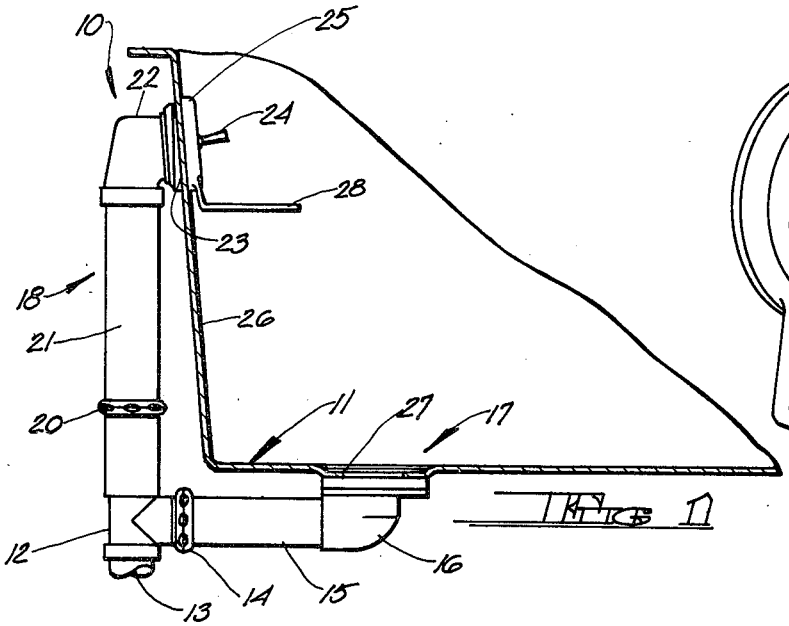
FIG. 1 is a side elevation view of a typical bathtub drain assembly incorporating one embodiment of the bathtub support grip of the present invention.
Figure 2:
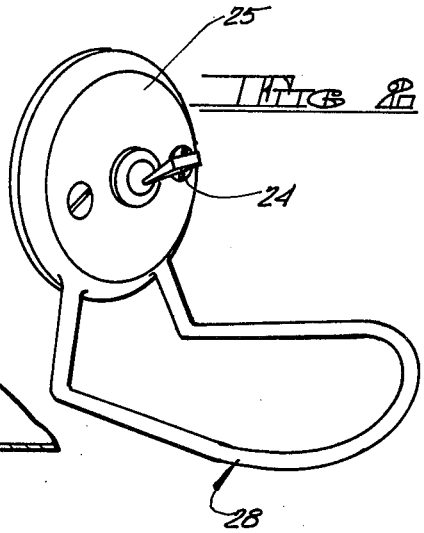
FIG. 2 is a perspective view showing in greater detail the bathtub support grip depicted in FIG. 1.

Referring now to the drawings, and particularly to FIGS. 1 and 2, one embodiment of the support grip of the present invention is shown mounted in association with a typical bathtub drain assembly. The bathtub drain assembly, indicated generally by reference numeral 10, is shown mounted is association with a bathtub 11 and generally comprises a waste T 12 having an outlet 13, the waste T 12 being connected by a suitable slip nut 14 to a waste arm 15. The waste arm 15 is connected in the usual manner to a waste shoe 16 which communicates with a suitable drain 17.

The waste T 12 is provided at its upper end with an overflow arm 18 comprising a lower member 19 carrying a suitable slip nut 20 for engagement with the upper member 21. The upper member 21 is connected to the usual overflow head 22 which, in turn, is connected to an overflow opening 23 in tub 11 in any conventional manner. It will be appreciated that overflow head 22 is intended to provide for the overflow of water in the tub 11 if it reaches the overflow opening 23.

The bathtub drain assembly 10 further includes a control lever 24 pivotally mounted in the face plate 25, the latter being secured adjacent wall 26 of the bathtub 11 and securely connected to the overflow head 22 in any conventional manner. Typically, the face plate 25 is secured to the overflow head 22 by retaining screws or the like which pass through the face plate 25 and mate with cooperating means in the overflow head 22 for securely fastening the face plate 25 thereto. It will also be appreciated that various gaskets and washers may be provided intermediate the overflow head 22 and the face plate 25 to insure a water-tight seal therebetween and with the tub wall.

It will further be appreciated that the lever 24 will typically connect to an operating mechanism, not shown, which is connected at its other end to a stopper 27 located in the drain 17. Thereby, by operating lever 24, the stopper 27 may be lowered and raised to close and open the drain 17.

The bathtub support grip 28, as shown in FIGS. 1 and 2, integrally depends from the face plate 25 and comprises a loop-like structure configured for convenient grasping by a bather. It will be understood that the support grip 28 is disposed relative to tub 11 to at least partially support the weight of the bather and to facilitate the bather in raising and lowering himself within the tub. And, since the support grip 28 and the face plate 25 comprise a unitary structure securely fastened to the overflow head 22, the tendency for the support grip 28 to loosen or become disengaged from its mounting is quite minimal. Moreover, since the casting adjacent the back of tub 11 and associated with the overflow head 22 is larged than the hole in the tub over which the face plate 25 is typically mounted, it will be virtually impossible to pull the face plate 25 therethrough.

Figure 3:
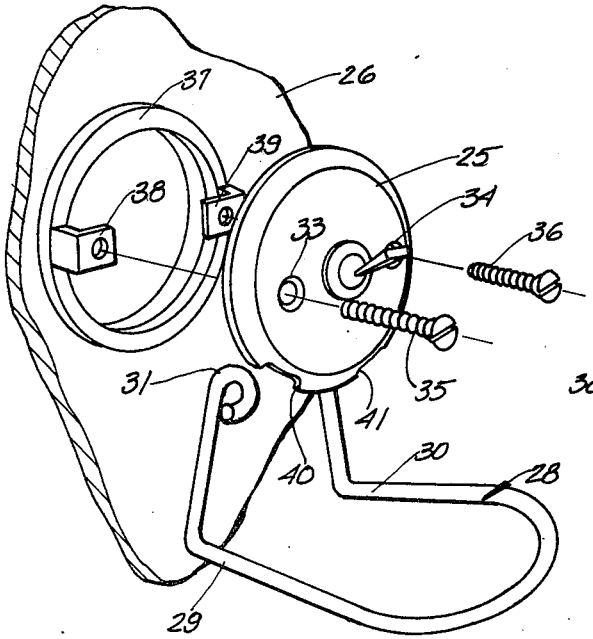
FIG. 3 is an exploded perspective view showing another embodiment of the bathtub support grip of the present invention.
Figure 4:
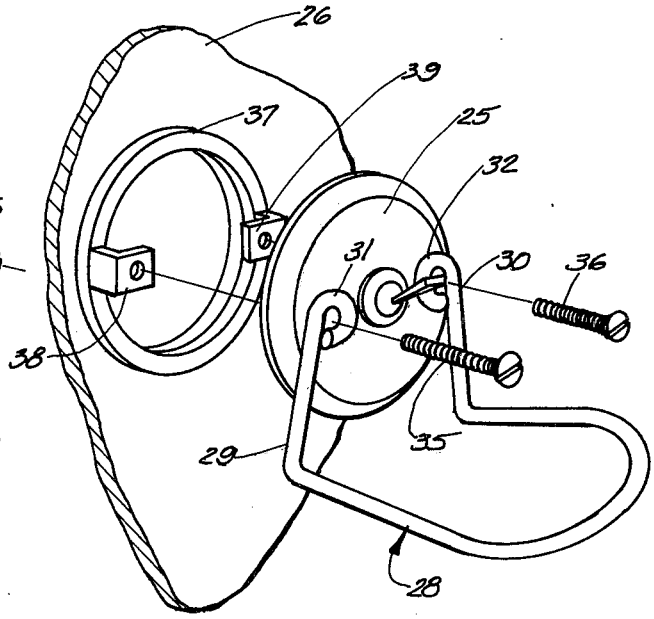
FIG. 4 is an exploded perspective view of yet another embodiment of the bathtub support grip of the present invention.

Further embodiments of the support grip of the present invention are shown in FIGS. 3 and 4. In FIG. 3, as well as in FIG. 4, the support grip 28 comprises a generally U-shaped loop-like structure having a pair of arms 29 and 30 terminating in looped sections 31 and 32.

In FIG. 3, the support grip 28 is disposed partially underlying face plate 25 so that looped sections 31 and 32 align with apertures 33 and 34 in face plate 25. The retaining screws 35 and 36 first pass through apertures 33 and 34 and then through the apertures in looped sections 31 and 32. Generally, the bath drain assembly 10 includes an annular mounting plate 37 adjacent the wall 26 of tub 11 and intermediate the face plate 25 and overflow head 22. The mounting plate 37 may be secured to the overflow head 22 and wall 26 by passing retaining screws 35 and 36 through aligned apertures in tabs 38 and 39, the retaining screws 35 and 36 then engaging cooperting screw receiving means in the overflow head 22 to firmly and securely join the assembly including the support grip 28 together. Alternatively, the mounting plate 37 may be secured to the overflow head 22 by independent means, not shown, and the face plate 25 and support grip 28 combination secured directly to the mounting plate 37. Also the face plate 25 may be modified to include cut-out portions 40 and 41 to facilitate the passage of arms 29 and 30 of support grip 28 relative the face plate 25.

The embodiment of the support grip 28 of the present invention shown in FIG. 4 is substantially identical to that shown in FIG. 3 except for its mounting relative to the face plate 25. In this regard, it will be noted that in FIG. 4 the support grip 28 is mounted overlying face plate 25 in lieu of underlying the face plate as in FIG. 3. Therefore, in the FIG. 4 embodiment the retaining screws 35 and 36 first pass through the apertures in looped sections 31 and 32 and then through apertures 33 and 34 of face plate 25 to secure the support grip 28 thereto. The face plate 25 may be fastened in association with the overflow head 22 as previously described.

Although the invention has been shown in connection with certain specific embodiments, it will be readily apparent to those skilled in the art that various changes in form and arrangement of parts may be made to suit requirements without departing from the spirit and scope of the invention. For example, it is within the scope of the present invention to utilize bath drain assemblies other than that specifically shown herein, it only being required that means are provided connecting face plate to the internal plumbing network. Also, it will be understood that the specific shape of the support grip illustrated herein is not considered limiting, shapes other than that shown adapted to be conveniently grasped being contemplated by the present invention.

The embodiments of the invention in which an exclusive property or privilege is claimed are defined as follows:

1. In a bathtub drain assembly of the type located exteriorly of the bathtub and having an overflow head connected to an overflow opening in a wall of the bathtub and having a face plate located adjacent the inside surface of said wall of the bathtub and operatively connected to said overflow head, the improvement comprising a support grip having a substantially U-shaped portion extending away from the inside surface of said wall of the bathtub for grasping by a bather's hand to at least partially support and facilitate the bather in raising and lowering himself in said bathtub, and means for fastening said support grip to the overflow head.

2. The improvement according to claim 1 wherein said U-shaped portion is an integral one-piece part of said face plate.

3. The improvement according to claim 1 wherein the terminating ends of the legs of said U-shaped portion adjacent the overflow head are so configured that said fastening means may pass therethrough to secure said support grip to the overflow head.

4. The improvement according to claim 3 wherein said terminating ends of the legs of said U-shaped portion are disposed underlying said face plate adjacent the surface thereof facing toward said wall.

5. The improvement according to claim 3 wherein said terminating ends of the legs of said U-shaped portion are disposed overlying said face plate adjacent the surface thereof facing away from said wall.

6. The improvement according to claim 1 including a portion extending downwardly from the overflow head, said U-shaped portion extending outwardly from the lowermost end of said downwardly depending portion.

* * * * *